US006360915B1

(12) United States Patent
Eriksson

(10) Patent No.: US 6,360,915 B1
(45) Date of Patent: Mar. 26, 2002

(54) TUBULAR PACKAGE CONTAINER

(76) Inventor: Vilho Eriksson, Östra Henrikbergesvägen 45, S-131 31 Nacka (SE)

( * ) Notice: Subject to any disclaimer, the term of this patent is extended or adjusted under 35 U.S.C. 154(b) by 0 days.

(21) Appl. No.: 09/341,964

(22) PCT Filed: Jan. 21, 1998

(86) PCT No.: PCT/SE98/00088

§ 371 Date: Jul. 20, 1999

§ 102(e) Date: Jul. 20, 1999

(87) PCT Pub. No.: WO98/31606

PCT Pub. Date: Jul. 23, 1998

(30) Foreign Application Priority Data

Jan. 21, 1997 (SE) ..... 9700159

(51) Int. Cl.[7] ..... B67D 5/00
(52) U.S. Cl. ..... 222/83.5
(58) Field of Search ..... 222/81, 83, 83.5

(56) References Cited

U.S. PATENT DOCUMENTS

| | | | | | |
|---|---|---|---|---|---|
| 2,823,832 | A | * | 2/1958 | Potter | 222/83.5 |
| 3,190,759 | A | | 6/1965 | Stryk et al. | |
| 4,771,916 | A | * | 9/1988 | Mitchell | 222/83.5 |
| 4,907,722 | A | * | 3/1990 | Ueda et al. | 222/83 |
| 5,141,134 | A | * | 8/1992 | Machado | 222/83.5 |

FOREIGN PATENT DOCUMENTS

| | | | |
|---|---|---|---|
| DE | 29600994 | * | 1/1996 |
| DE | 296 00 994 | | 4/1996 |
| EP | 0468265 | * | 7/1991 |
| EP | 0 468 265 | | 1/1992 |
| IT | 622679 | * | 6/1961 |
| SE | 9302371-1 | | 4/1996 |
| WO | WO 97/02182 | | 1/1997 |

OTHER PUBLICATIONS

Japanase Abstract: "Device for preventing deformation of container and furnished with microwave reflector"; Mitsubishi Monsanto Kasei KK JP58031976–830224, figure 1.

* cited by examiner

*Primary Examiner*—Kevin Shaver
*Assistant Examiner*—Melvin A. Cartagena
(74) *Attorney, Agent, or Firm*—Akerman Senterfitt

(57) ABSTRACT

Among all the known packages for soft and fluid products, the flexible tube type package is the most uncomplicated and most cost-effective. It, however, suffers from being relatively difficult to open, not to be reclosed and not allowing convenient handling when to being emptied. These problems have found their solution through the invention which mainly is characterized by the flexible tube type package at one of its ends being provided with thin collar (2) of a semi-rigid material such as cardboard or a soft plastic or a more rigid material. The collar is arranged such that the filled package can be placed standing with one of the collar edges resting against the support surface. In a particular embodiment the package is also surrounded by a round jar (3), the inner dimensions of which fitting to the diameter of the collar, and a lid (4) which is provided with a sharp point (7).

9 Claims, 2 Drawing Sheets

TUBULAR PACKAGE CONTAINER

This invention concerns a package according to the preamble of claim 1. It also concerns a method of heat treatment of such a package in accordance with the preamble of claim 7.

Among the various known packages for soft and fluid products the flexible tube type package is the most uncomplicated and most cost-effective type. It is successfully used for technical products as well as food products, particularly when the product needs to be heat-treated after filling. The cylindrical shape result in a strong package capable of resisting an inner overpressure, and it brings about the smallest possible material demand. The flexible tube type package suffers, however, from being rather difficult to open, not being reclosable and further not allowing simple handling when emptying the contents. Even if the drawbacks have been diminished by the presence of a lid according to the Swedish Patent No. 9302371-1, essential problems remain which have found there solution by the present invention. The invention is mainly characterized in that a flexible tube type package at one of its ends is provided with a thin collar of a semi-rigid material such as cardboard or a soft plastic being arranged such that the filled package can be placed standing with one edge of the collar resting against a support surface. Stiffer materials may however, be used for the collar. In a particular embodiment, the package is surrounded by a round jar or an open pipe, the inner dimensions of which fitting to the diameter of the collar, and a lid provided with a sharp point. A method of filling and a method of heat treatment is also included. The invention will be described in greater detail in the following with the reference to the annexed drawings, wherein:

Figure 1:
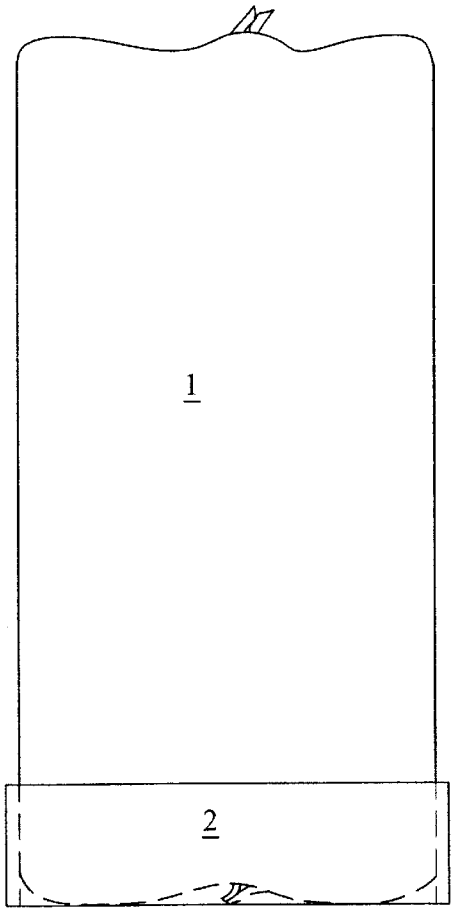
FIG. 1 shows the package in a side view.

According to FIG. 1 a hose type package 1, of a per see known type, at one of its ends is provided with a ring shaped collar 2, which preferably is made of a semi-rigid material, such as cardboard or a soft plastic. It may, however, also be made of an essentially more rigid material. In case of a package having a height of about 10–20 cm, the collar is preferably about 2 cm wide or lower depending on the diameter of the package and only needs to have such a thickness that it is considerably more rigid that the material of the flexible tube. As an example for a normal package having a diameter of 70–75 mm, the thickness is preferably about 0.25–0.50 mm. It may be produced in advance and be applied to the tube type package, either in connection with its filling or thereafter, but it may also be wound onto the filled package, also after heat treatment, in the form of a band, whereby a certain overlap ensures an effective connection. In both cases it is essential that the inside of the collar is capable of adhering to the tube material. This may be achieved with a layer of glue or effected by raised temperature in connection with the heat treatment usually following filling.

Figure 2:
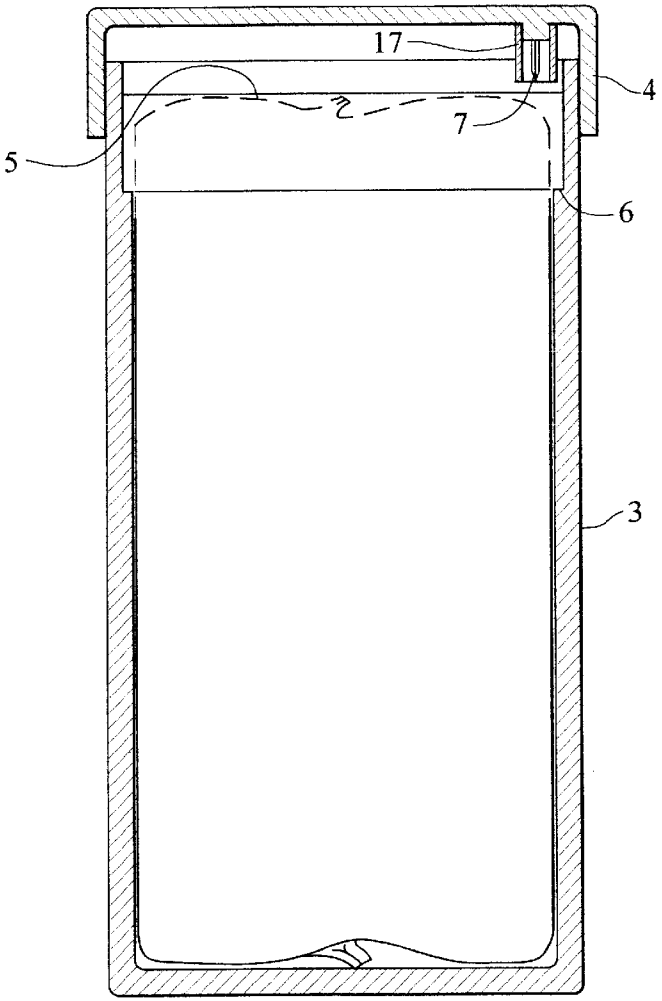
FIG. 2 shows the package with a surrounding jar.

The tube type package provided with the collar may be packed, exposed and be kept standing on one edge of the collar which saves space and gives overview. The collar may also be used for information about the contents in an otherwise neutral package. Already this is an essential advantage with the collar but it is further useful. If a jar 3 or plastic or cardboard, the inner dimension of which fitting to the diameter of the collar 2, is placed outside the package according to FIG. 2, the possibility is presented to easily open and reclose a flexible tube type package with the aid of a lid 4 fitting to the jar. Since the collar holds the upper end of the flexible tube type package stressed outwards in a round shape without the aid of the contents of the package, the upper end part 5 of the package may be cut away and the entire contents be made accessible. A shoulder 6 in the wall of the jar 3 prevents the package from successively sinking when it is emptied. According to the invention, for extra convenient cutting, a knife or a point 7 of a simple type may be applied excentrically at the lower side of the lid 4. The opening will then result from the lid being pressed down and turned one turn, whereby the point 7 makes a hole in the tube type package and cuts away its upper end part 5. The point 7 may be made in one piece with the lid 4 and is hygienically protected thereby. A distance element 17 prevents the point 7 from piercing the package during delivery but is easily removed before opening. It is also possible to provide the lid with two points 7, whereby for opening the package, the lid only has to be turned half a turn. A jar may also be made without a shoulder, whereby the collar may rest on the upper edge of the jar.

Figure 3:
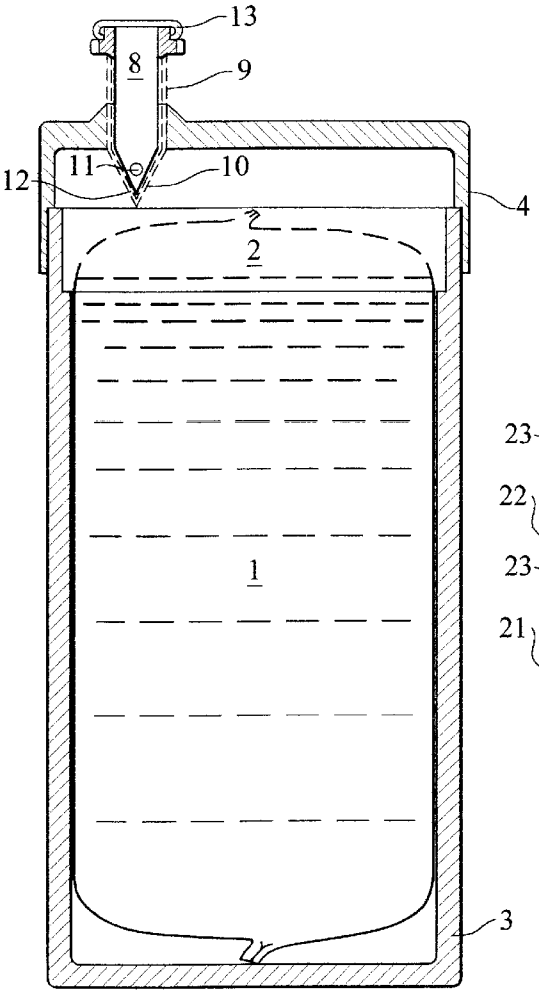
FIG. 3 shows an embodiment of the lid of the jar.

If the contents of the package is liquid, the lid 4 should instead of the point 7 be provided with a pipe 8, which is provided with a thread 9 co-operating with a threaded hole in the lid and a conical point 10 having openings 11 and a thread 12. See FIG. 3. When the pipe is screwed down into the lid, the thread 9 gives a pressure resulting in piercing of the package at the point 10 so that with continued screwing, the thread 12 will co-operate with the elastic material of the flexible tube type package and as a results of its conical shape, give a very good seal thereagainst. The pipe 8 will thereafter communicate through the openings 11 with the contents of the package which may be poured or sucked out. Emptying is enhanced by the thin wall of the package easily being wrinkled except at the collar 2. An elastic lid 13 on the pipe will serve for reclosing the package. The package in question is also suitable for carbonated liquids and is also useful for chemical technical products. As an alternative to the jars shown on FIG. 2 and 3, a "jar" 3 shaped as a tube without a bottom may be used, resulting in a package which is still cheaper to manufacture.

The invention also envisages that the jar 3 is recycled and that the tube type package with a collar is delivered to the user as a refill container. It is preferred that the tube and the collar is made of materials which are related so that they are recyclable together. Hereby conventional materials for hose type packages will come into question, often multilayer materials, preferably co-extruded. Depending on the use, i.a. polyethylene, EVA and other materials having various barrier properties may be used.

The collar is useful also together with conventional hose type packages with clips.

Figure 4:
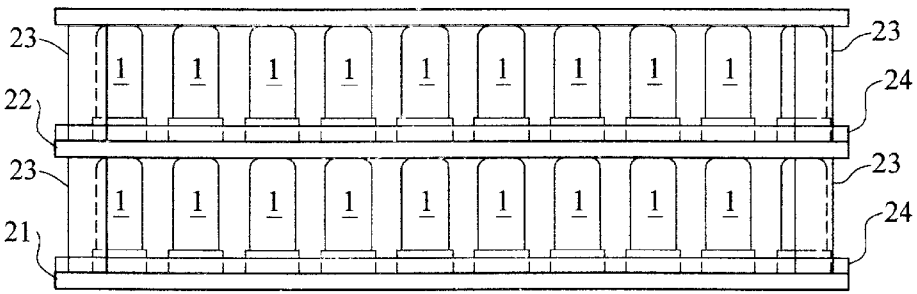
FIG. 4 shows a device for use in heat treatment.

The invention of the tube type package with a collar has also opened a possibility of simplifying the package, if a new filling method is included. All known flexible tube type packages are now closed with the aid of metal clips, since the weld seams at its ends will not alone withstand the inner over-pressure when the filled package is heat-treated. The metal clips are on the one hand difficult to remove, on the other hand a source of disturbances when recycling or destruction of empty packages. By flexible tube type packages with the aid of the collar being possible to place standing up, there are possibilities provided for heat treating them in a standing position. FIG. 4 shows a great number of packages being placed on a plate 21 having edge strips 24 and being loaded with a plate 22 resting thereon, which in turn make carry packages standing in the same way. This may be repeated for a number of levels, and a corresponding load will be put on the uppermost plate. As a limitation of the pressure on the lower levels, the plates may be provided with vertical distance pipes 23 having a height barely corresponding to that of the finished package. The packages are heat-sealed at their ends, preferably in such a way that the tube material is first compressed to an essentially round, thin string which thereafter is entirely melted together. The gathering and compressing is preferably obtained by V-shaped surfaces on two parts moveable against and past each other which are placed in pairs on either side of the sealing jaws. Metal clips are not used. The pressure exerted by the plates 21, 22 and so on reduce the stress from the inner pressure at the heat treatment to such an extent that the heat seal will not open thereof. The reason for the seal not to be pressed up from the over-pressure created at the heat treatment, e.g. the pasteurization, occurring because of the increased volume of the contents of the package in combination with the negative effect of the heat treatment on the seal, is that a limitation of the possibility of the flexible tube type package to expand longitudinally result in minimized radial tearing forces in the package material in the areas of the seals and thereby minimized stress in these areas.

Beside the great advantage of the elimination of the metal clips, the method have economic advantages as to more concentrated heat treatment and reduced space demand. The placement of packages on plates and stacking of these is a task that may simply be carried out by an industrial robot. It is clear that the method can also be carried out using somewhat more spacy collars attached to the plates, but it is mainly connected to packages with collars of the above described type.

However, it is clear that the method may also be used more generally in heat treatment of flexible tube type packages which are sealed in the above mentioned way without metal clips and having a contents, and also without a collar. This can be done by preventing or at least limiting the longitudinal expansion of the flexible tube type package. Hereby limiting means, compartments, recesses or the like are used during the heat treatment, which means provide such a reception length that carefully corresponds to the allowed length of the heat-treated package. It is often a question of pressing down the filled tube type package before the heat treatment in a space having less length than the package itself, whereby an inwardly directed longitudinal pressure will be achieved already from the start. An extra effect of this is that the finished product will have with flattened end surfaces.

What is claimed is:

1. A package of the flexible tube package type for soft and fluid or powder form products, comprising:

a package wall;

wherein at least one end of the package is provided with a thin, ring-shaped, bottomless supporting collar of a rigid or semi-rigid material; and wherein an inner portion of the collar is adhered to the package wall and arranged such that the filled package can be placed standing with an edge of the collar resting against a support surface.

2. The package according to claim 1, further comprising a surrounding round jar, the inner dimensions of which correspond with a diameter of the collar and a lid fitting to the jar.

3. The package according to claim 2, wherein the jar has an inside with a shoulder arranged to prevent the collar from sliding down inside the jar when the package is emptied of its contents.

4. The package according to claim 3, wherein the lid has an inside provided with an eccentrically located knife or point, wherein, after the disposal of a distance element, the knife or point can cut away the upper end surface of the package when the lid is turned one turn with respect to the jar.

5. The package according to claim 3, wherein the lid is provided with a threaded hole matching a thread on a pipe, which is provided with a threaded, conical point having openings through which the contents of the package may flow out when the point has been screwed into the upper end surface of the package.

6. The package according to claim 2, wherein the lid has an inside provided with an eccentrically located knife or point, wherein, after the disposal of a distance element, the knife or point can cut away the upper end surface of the package when the lid is turned one turn with respect to the jar.

7. The package according to claim 2, wherein the lid is provided with a threaded hole matching a thread on a pipe, which is provided with a threaded, conical point having openings through which the contents of the package may flow out when the point has been screwed into the upper end surface of the package.

8. A package of the flexible tube package type for soft and fluid products, comprising:

a package wall;

wherein at least one end of the package is provided with a thin collar of semi-rigid material;

an inner portion of the collar adhered to the package wall and arranged such that the filled package wall can be placed standing with an edge of the collar resting against a support surface;

a surrounding round jar, the inner dimensions of which correspond with a diameter of the collar and a lid fitting to the jar; and wherein the jar has an inside with a shoulder arranged to prevent the collar from sliding down inside the jar when the package is emptied of its contents.

9. A package of the flexible tube package type for soft and fluid products, comprising:

a package wall;

wherein at least one end of the package is provided with a thin collar of semi-rigid material;

an inner portion of the collar adhered to the package wall and arranged such that the filled package wall can be placed standing with an edge of the collar resting against a support surface;

a surrounding round jar, the inner dimensions of which correspond with a diameter of the collar and a lid fitting to the jar; and wherein the lid has an inside provided with an eccentrically located knife or point, wherein, after the disposal of a distance element, the knife or point can cut away the upper end surface of the package when the lid is turned one turn with respect to the jar.

* * * * *